United States Patent [19]

Koepsel et al.

[11] Patent Number: 4,897,061

[45] Date of Patent: Jan. 30, 1990

[54] GEARCASE EXHAUST VENT FOR A MARINE PROPULSION SYSTEM

[75] Inventors: Roger E. Koepsel; Ronald M. Steiner, both of Oshkosh, Wis.

[73] Assignee: Brunswick Corporation, Skokie, Ill.

[21] Appl. No.: 228,321

[22] Filed: Aug. 4, 1988

[51] Int. Cl.[4] ..... B63H 21/32

[52] U.S. Cl. ..... 440/89

[58] Field of Search ..... 440/88, 89; 60/272, 60/324; 181/235, 237

[56] References Cited

U.S. PATENT DOCUMENTS

| | | | |
|---|---|---|---|
| 2,570,509 | 10/1951 | Bandli | 440/89 |
| 3,434,447 | 3/1969 | Christensen et al. | 440/89 |
| 3,745,964 | 7/1973 | Henrich | 440/89 |

*Primary Examiner*—Sherman D. Basinger

*Attorney, Agent, or Firm*—Andrus, Sceales, Starke & Sawall

[57] ABSTRACT

A marine propulsion system in which exhaust is routed through an internal exhaust passage which includes a convergent area forming a restricted flow path includes a pressure relief opening formed adjacent the area of restricted exhaust flow for relieving exhaust pressure. One or more closure plates are connected adjacent the one or more openings to selectively control the passage of exhaust therethrough. The plates are biased toward a closed position in which exhaust is prevented from passing through the openings. The bias on the plates is designed so as to yield to a predetermined level of exhaust pressure within the exhaust passage at the area of restricted exhaust flow, to thereby relieve exhaust pressure build-up and improve the performance of the marine propulsion system.

7 Claims, 1 Drawing Sheet

GEARCASE EXHAUST VENT FOR A MARINE PROPULSION SYSTEM

BACKGROUND AND SUMMARY

This invention relates to a marine propulsion system, and more particularly to an exhaust discharge system for a marine propulsion system.

In a marine propulsion system, it is known to route exhaust gas through an internal exhaust discharge passage formed in the housing of the marine propulsion system. In an outboard motor, for example, the exhaust discharge system typically includes an exhaust passage provided in the lower unit of the motor which houses the driveshaft and the gearcase. A propeller is generally mounted to a propeller shaft disposed in the lower end of the lower unit, and it is desirable to provide an exhaust passage which discharges exhaust through the hub of the propeller. Such discharge of the exhaust provides quiet operation of the motor and enhances performance. A similar manner of discharging exhaust is used in connection with a stern drive system.

It is also desirable to minimize the surface area of that portion of the lower unit which is disposed below the water level during normal operation of a boat, in order to reduce drag developed by such submerged portion. This desirability for reducing the surface area of the submerged portion of the lower unit housing results in a configuration of the lower portion of the gearcase which provides a restricted area for exhaust flow through the exhaust discharge passage formed therein. This restricted area of exhaust flow is normally located immediately upstream of the entrance of the exhaust into the propeller shaft housing. At certain operating conditions, such area of restricted exhaust flow can cause a bottleneck in the exhaust discharge system which is unable to accommodate the exhaust output produced by the engine. In this circumstance, the performance of the engine suffers.

The present invention is designed to overcome the above-noted shortcomings in the exhaust discharge system for a marine propulsion system. In accordance with the invention, in an exhaust system including an area of restricted exhaust flow, relief means is provided adjacent the area of restricted exhaust flow for relieving exhaust pressure. In one embodiment, the relief means comprises one or more openings in the housing of the lower gearcase for providing an alternate outlet for exhaust adjacent the area of restricted flow. Closure means is provided adjacent the one or more openings for selectively opening and closing the openings for regulating the flow of exhaust gas therethrough. The closure means may be responsive to the pressure of exhaust within the exhaust passage adjacent the area of restricted exhaust flow. In one embodiment, the closure means comprises one or more plates adapted to cover the one or more openings, with the plates being movable between an open position and a closed position. A bias means acts to bias the one or more plates toward their closed position, and the bias means is designed so as to yield to a predetermined exhaust pressure within the exhaust passage so as to allow the one or more plates to move to their open position. In one embodiment, the one or more plates are formed of a resilient material, such as a spring steel, and are mounted to the gearcase housing so that the resilience of the material biases the one or more plates toward their closed position.

BRIEF DESCRIPTION OF THE DRAWINGS

The drawings illustrate the best mode presently contemplated of carrying out the invention.

In the drawings

DETAILED DESCRIPTION OF THE PREFERRED EMBODIMENT

Figure 1:
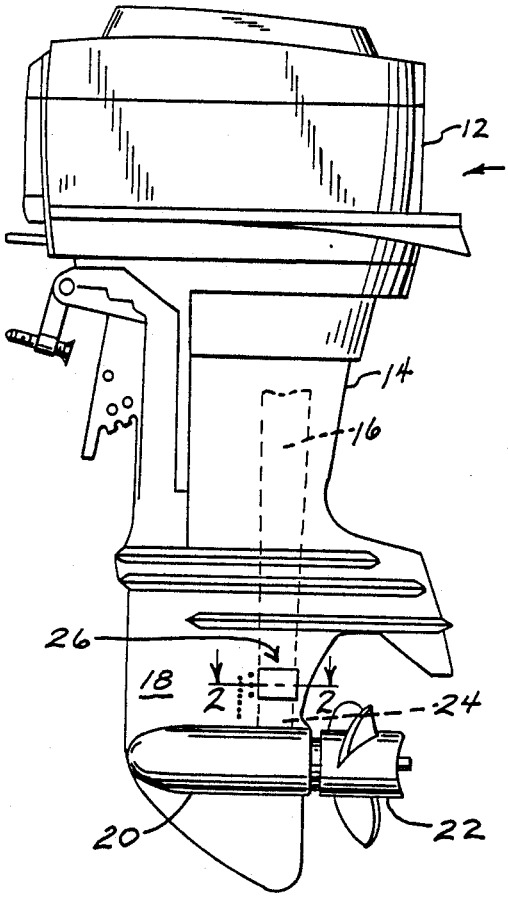
FIG. 1 is a side elevation view of an outboard marine motor and depending gearcase incorporating the exhaust relief outlet according to the invention.

With reference to FIG. 1, an outboard motor 10 includes a power head 12 and a depending gearcase 14. Power head 12 typically includes an internal combustion engine (not shown) from which exhaust is routed through an internal exhaust passage 16 formed in gearcase 14. Exhaust passage 16 generally extends from the upper end of gearcase 14 to the lower end of gearcase 14, shown generally at 18. A "torpedo" 20 is formed in lower end 18 of gearcase 14 and houses a propeller shaft to which a propeller 22 is mounted. Exhaust passage 16 is generally in communication at its lower end with an internal passage formed in torpedo 20 which routes the exhaust gas therethrough and discharges exhaust through the hub of propeller 22.

In the lower end of gearcase 14, the walls of exhaust passage 16 generally converge due to the desirability of minimizing the surface area of the lower end 18 of gearcase 14. The converging walls of exhaust passage 16 define an area of restricted exhaust flow, designated generally at 24. This area 24 of restricted exhaust flow can, under some operating conditions, operate as a bottleneck for exhaust passing through exhaust passage 16, which adversely affects the performance of the engine. To relieve the exhaust pressure within exhaust passage 16 at restricted area 24, an exhaust vent 26 is provided in the side wall of gearcase 14 adjacent restricted area 24.

Figure 4:
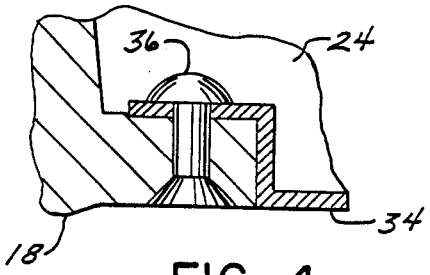
FIG. 4 is a detail view showing the connection of the outlet closure plate to the lower unit housing.
Figure 2:
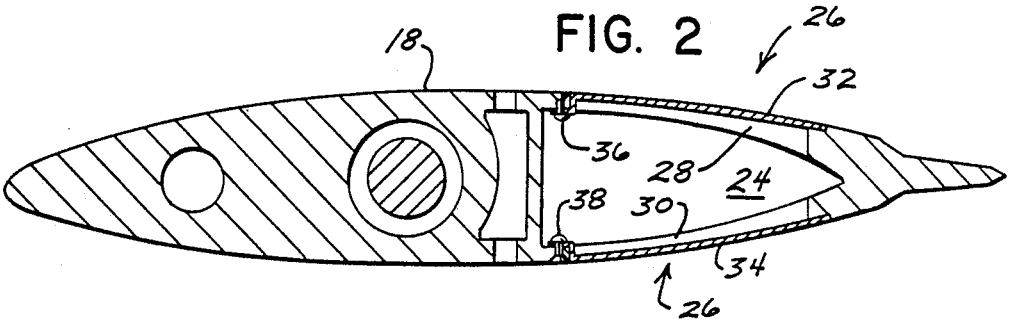
FIG. 2 is a sectional view taken generally along line 2—2 of FIG. 1 showing the outlet closure plates in their closed position.

With reference to FIG. 2, it is seen that exhaust vent 26 generally includes a pair of openings 28, 30 formed in the side walls of gearcase 14 adjacent area 24 of restricted exhaust flow. Openings 28, 30 are provided with respective closure plates 32, 34, connected to gearcase 14 by means of connectors 36, 38, respectively. Connectors 38 may be screws, rivets or any satisfactory fastening means. As shown in FIG. 4, connectors 36, 38 are rivets connecting the closure plates, such as 34, to lower portion 18 of gearcase 14.

Closure plates 32, 34 are preferably formed of a resilient material such as a spring steel. Closure plates 32, 34 are formed and attached to gearcase 14 so as to be biased toward their closed position as shown in FIG. 2, in which closure plates 32, 34 seal openings 28, 30 to prevent passage of exhaust gas therethrough.

Figure 3:
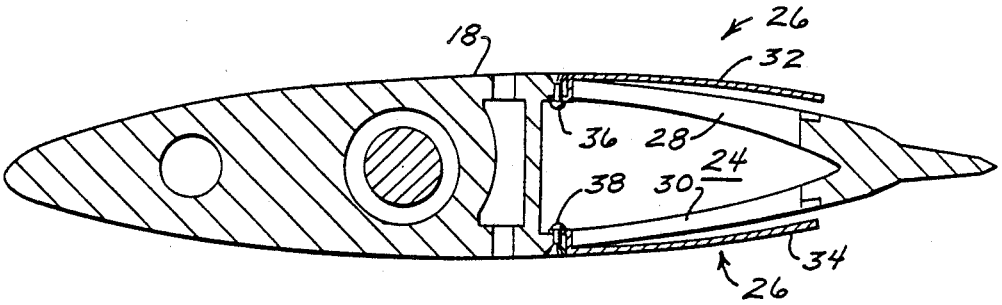
FIG. 3 is a view similar to FIG. 2, showing the outlet closure plates in their open position.

As shown in FIG. 3, closure plates 32, 34 are movable to an open position in which exhaust passing through restricted area 24 in exhaust passage 16 is allowed to exit gearcase housing 14 through openings 28, 30, respectively. Closure plates 32, 34 are designed so as to be sensitive to exhaust pressure within restricted area 24 of exhaust passage 16. That is, when the pressure of exhaust in exhaust passage 16 at restricted area 24 reaches a certain predetermined level, the bias provided by the resilience of plates 32, 34 is overcome by such exhaust pressure and plates 32, 34 move from their closed position as shown in FIG. 2 to their open position as shown in FIG. 3. When exhaust pressure in restricted area 24 is relieved and falls below the predetermined pressure level, the bias provided by the resilience of plates 32, 34 acts to move plates 32, 34 back to their closed position.

With the construction described above, openings 28, 30 in the wall of gearcase 14 provide an alternate route of discharge for exhaust within exhaust passage 16 at restricted area 24 when a certain predetermined level of exhaust pressure is reached. In this manner, performance of the outboard motor is improved by relieving the bottleneck formed by restricted area 24 in exhaust passage 16.

It should be appreciated that the invention is useful not only with an outboard motor as shown in the drawings, but is equally applicable to any marine propulsion system in which exhaust is routed through a housing having a restricted area of flow, including a stern drive or an inboard system. It should also be appreciated that a separate bias means may be provided for the closure plates, and that a pressure relief valve or the like may be used in place of the openings as regulated by the closure plates.

Various alternatives and modifications are contemplated as being within the scope of the following claims particularly pointing out and distinctly claiming the invention.

We claim:

1. In a marine propulsion system in which engine exhaust is routed through an internal exhaust passage formed within a housing prior to discharge through an exhaust outlet, said exhaust passage including at least one area of restricted exhaust flow, the improvement comprising relief means comprising one or more openings in said housing disposed adjacent said area of restricted exhaust flow for relieving exhaust pressure adjacent said area of restricted exhaust flow by providing an alternate outlet for exhaust adjacent said area of restricted flow, and closure means responsive to the pressure of exhaust within said exhaust passage adjacent said area of restricted flow for selectively opening and closing said one or more openings, wherein said closure means comprises:

one or more plates adapted to cover said one or more openings, said one or more plates being movable between an open position in which exhaust is allowed to exit said exhaust passage through said one or more openings, and a closed position for preventing the passage of exhaust through said one or more openings; and bias means for biasing said one or more plates toward said closed position, said bias means yielding to a predetermined exhaust pressure within said exhaust passage so as to allow said one or more plates to move to their open positions.

2. The invention according to claim 1, wherein said one or more plates are formed of a resilient material, and wherein said one or more plates are formed and attached to said housing so that the resilience of said material biases the said one or more plates toward their closed position.

3. The invention according to claim 2, wherein said one or more plates are formed of a resilient metal.

4. In a marine propulsion system including a lower unit with a propeller connected thereto, and in which engine exhaust is routed through an internal exhaust passage formed in the lower unit prior to its discharge through the hub of the propeller, said internal exhaust passage in said lower unit including a convergent area forming a restricted flow path for the exhaust passage therethrough, the improvement comprising a pressure relief opening formed in a wall of said lower unit adjacent said convergent area of said internal exhaust passage for providing an alternate outlet for exhaust from said exhaust passage, and closure means operatively responsive to a predetermined exhaust pressure threshold within said exhaust passage for selectively opening and closing said pressure relief opening in response to the level of exhaust pressure therewithin.

5. The invention according to claim 4, wherein said closure means is responsive to the pressure of exhaust within said exhaust passage adjacent said area of restricted exhaust flow.

6. The invention according to claim 5, wherein said closure means comprises:

one or more plates adapted to cover said one or more openings, said one or more plates being movable between an open position in which exhaust is allowed to exit said exhaust passage through said one or more openings, and a closed position for preventing the passage of exhaust through said one or more openings; and bias means for biasing said one or more plates toward said closed position, said bias means yielding to a predetermined exhaust pressure within said exhaust passage so as to allow said one or more plates to move to their open position.

7. The invention according to claim 6, wherein said one or more plates are formed of a resilient metal such as spring steel or the like, and wherein said one or more plates are formed and mounted to said housing so that the resilience of said metal biases said one or more plates toward their closed position.

* * * * *